US009468316B1

(12) United States Patent
Johnson et al.

(10) Patent No.: US 9,468,316 B1
(45) Date of Patent: Oct. 18, 2016

(54) UNDERFRAME ON A DISPLAY FIXTURE

(71) Applicant: Target Brands, Inc., Minneapolis, MN (US)

(72) Inventors: Jason W. Johnson, Wayzata, MN (US); Erin L. Zobel, Minneapolis, MN (US); Timothy J. Martell, Brooklyn Park, MN (US); Blake M. Johnson, St. Paul, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/666,783

(22) Filed: Mar. 24, 2015

(51) Int. Cl.

| | |
|---|---|
| ***A47B 37/00*** | (2006.01) |
| ***A47F 5/16*** | (2006.01) |
| ***G09F 3/20*** | (2006.01) |
| ***A47B 13/02*** | (2006.01) |
| ***A47F 5/00*** | (2006.01) |
| ***A47F 5/10*** | (2006.01) |

(52) U.S. Cl.
CPC ..... *A47F 5/16* (2013.01); *A47B 13/02* (2013.01); *A47F 5/0006* (2013.01); *A47F 5/10* (2013.01); *G09F 3/20* (2013.01)

(58) Field of Classification Search
CPC ..... A47F 5/16; A47F 5/0006; A47F 5/10; A47B 13/02; A47B 13/16; A47B 37/00; A47B 21/00; A47B 2200/0066; A47B 2200/008
USPC ..... 108/50.01, 50.02, 50.11, 28, 29, 30
See application file for complete search history.

(56) References Cited

U.S. PATENT DOCUMENTS

| | | | | |
|---|---|---|---|---|
| 1,807,589 | A | 6/1931 | Edmunds | |
| 2,606,666 | A | 8/1952 | Gray | |
| 2,964,202 | A | 12/1960 | Gingher et al. | |
| 2,971,651 | A | 2/1961 | Shoffner | |
| 3,023,908 | A | 3/1962 | Ramey | |
| 3,252,583 | A | 5/1966 | Walther et al. | |
| 3,730,355 | A | 5/1973 | Feldman | |
| 4,673,089 | A | 6/1987 | Chap | |
| D352,413 | S * | 11/1994 | Ballard | D6/553 |
| 5,769,514 | A * | 6/1998 | Brown | A47B 3/08 108/129 |
| 5,913,499 | A * | 6/1999 | Kiggins | A47F 5/0823 248/200 |
| 6,082,838 | A * | 7/2000 | Bissu-Palombo | A47B 3/12 108/115 |
| 6,099,094 | A * | 8/2000 | Lior | A47B 21/00 108/50.01 |

(Continued)

*Primary Examiner* — Jose V Chen
(74) *Attorney, Agent, or Firm* — Leanne Taveggia Farrell; Westman, Champlin & Koehler, P.A.

(57) ABSTRACT

A display fixture includes a main support frame, a table top supported by the main support frame, an underframe attached to the main support frame and located underneath the table top and at least one display hook that supports hanging products. The at least one display hook has a proximal end and a distal end. The proximal end is removably coupled to and supported by the underframe.

16 Claims, 6 Drawing Sheets

(56) References Cited

U.S. PATENT DOCUMENTS

| | | | | |
|---|---|---|---|---|
| 6,942,112 | B2 | 9/2005 | Robbins, III | |
| 6,969,036 | B2 | 11/2005 | Magnusson | |
| 6,997,115 | B2 * | 2/2006 | Lockwood | A47B 3/0803 108/115 |
| 7,429,024 | B2 | 9/2008 | Boklund-Moran | |
| 7,559,522 | B1 * | 7/2009 | Hlatky | A47B 23/02 108/1 |
| 7,966,951 | B1 * | 6/2011 | Black | H02G 3/128 108/50.01 |
| 8,196,525 | B2 * | 6/2012 | Flanet | A47B 17/00 108/28 |
| 8,312,820 | B2 * | 11/2012 | Rotlevi | A47B 21/00 108/50.01 |
| 2003/0010260 | A1 * | 1/2003 | Chang | A47B 17/00 108/50.01 |
| 2004/0060485 | A1 * | 4/2004 | Chang | A47B 83/001 108/50.01 |
| 2005/0103238 | A1 | 5/2005 | Paventi | |
| 2006/0065163 | A1 * | 3/2006 | Chi | A47B 21/03 108/7 |
| 2006/0249057 | A1 * | 11/2006 | Meyer | B25H 1/14 108/50.01 |
| 2013/0213918 | A1 | 8/2013 | Doyle, Jr. et al. | |
| 2014/0263919 | A1 | 9/2014 | Duffy et al. | |
| 2014/0366782 | A1 * | 12/2014 | Battey | G09B 19/00 108/28 |

* cited by examiner

UNDERFRAME ON A DISPLAY FIXTURE

BACKGROUND

Businesses, such as retail stores, use a variety of types of display structures to present products to customers for purchase. An example type of display structure is a shelf or table for holding products. Another example type of display structure is a display hook used to support hanging products. Exemplary display hooks include hooks for mounting to cross bars or cross wire supports, hooks for mounting to peg boards and hooks for mounting to slatted walls.

The discussion above is merely provided for general background information and is not intended to be used as an aid in determining the scope of the claimed subject matter.

SUMMARY

A display fixture includes a main support frame, a table top supported by the main support frame, an underframe attached to the main support frame and located underneath the table top and at least one display hook that supports hanging products and has a proximal end and a distal end. The proximal end is removably coupled to and supported by the underframe.

A display fixture includes a plurality of legs, a plurality of cross members. At least one of the plurality of cross members couple at least two of the plurality of legs together. A table top is located on top of the plurality of cross members, is supported by the plurality of cross members and the plurality of legs and is configured to support merchandise for display. The display fixture further includes a saddle frame having a plurality of support members coupled to a bottom of at least one of the cross members and is located under the table top and at least one display arm cantilevered from one of the support members of the saddle frame so that a distal end of the display arm is in view and a proximal end of the display arm is hidden from view by the table top. The display arm supports merchandise for display.

A method of displaying products on a display fixture includes setting products on an upper surface of a table top of a display fixture and loading hanging products on display hooks located under the table top of the display fixture. A proximal end of each display hook is removably coupled to an underframe located under the table top and a distal end of each display hook includes a label holder. Each label holder is located below an end of the table top.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

A display fixture includes a main support frame, a table top supported by the main support frame and an underframe or saddle frame located underneath the table top and coupled to the main support frame. The table top generally holds and displays products or merchandise that are piled on top of each other or otherwise arranged in some type of order. Display hooks mounted to the underframe below the table generally hold hanging products that are loaded on the display hooks from back to front. In this way, not only can items be displayed on the table top, but items can also be displayed from the hooks protruding from underneath the table so that the display fixture provides cross-merchandising of related products that require two different modes of display. For example, dishware can be displayed on the table top while linens, such as tablecloths and napkins, can be displayed from the display hooks underneath the table top.

Figure 1:
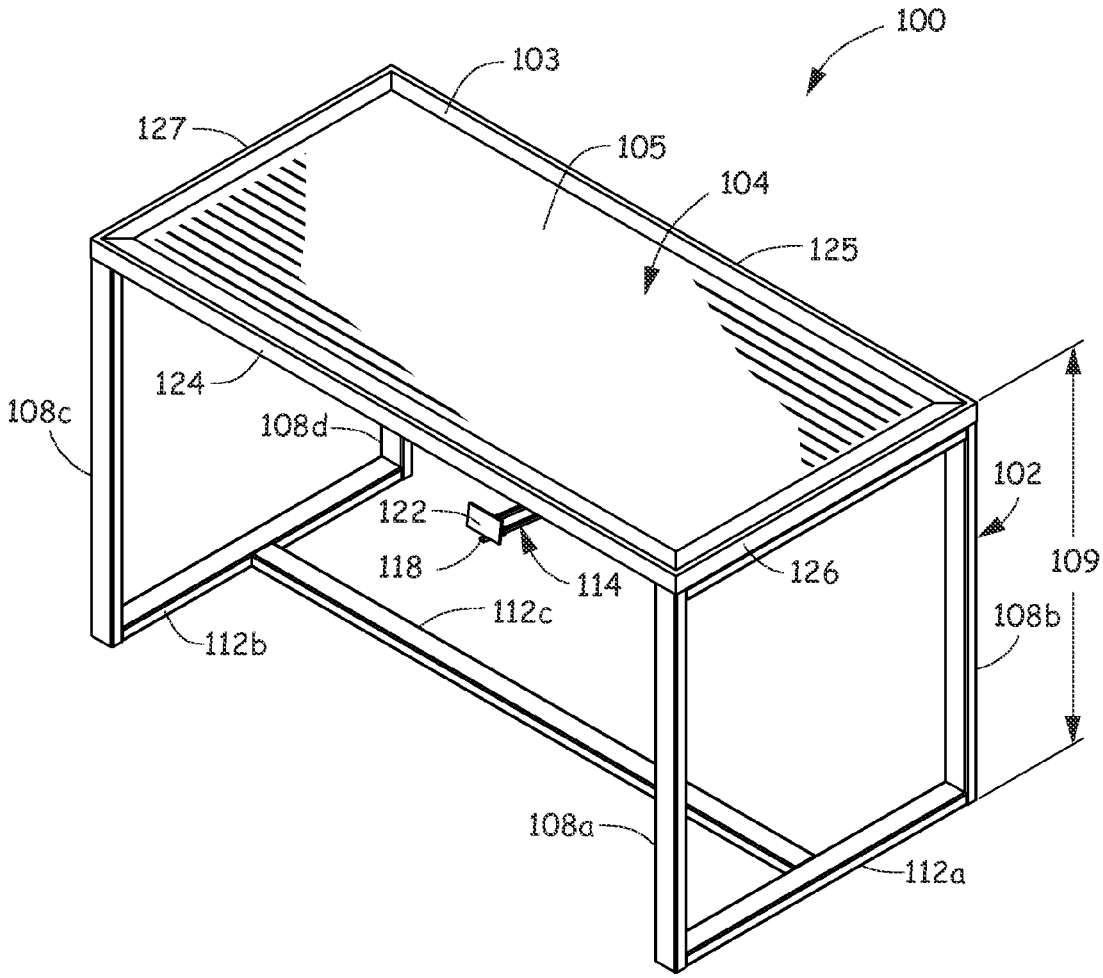
FIG. 1 is a perspective view of a display fixture according to one embodiment.
Figure 2:
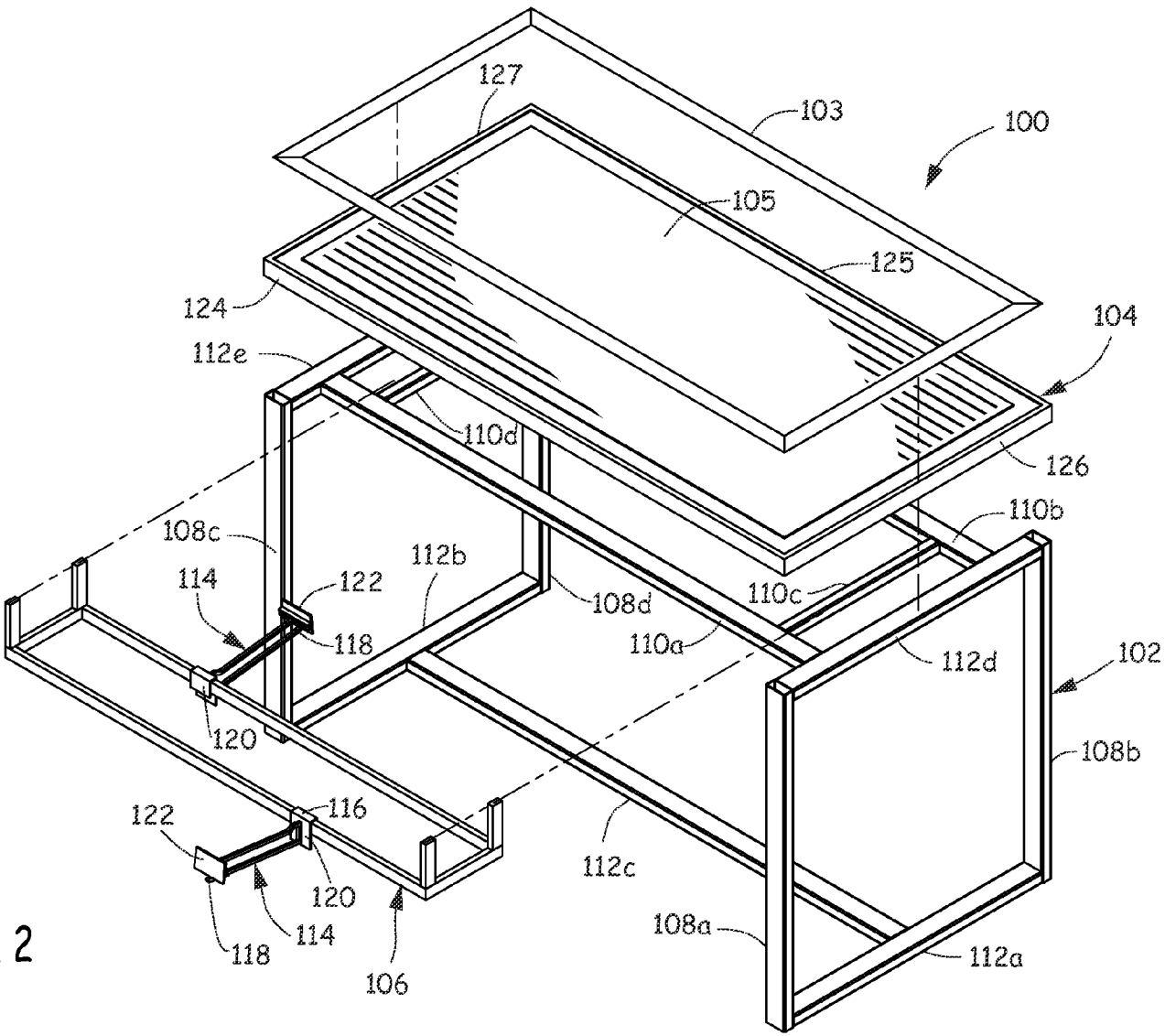
FIG. 2 is an exploded perspective view of the display fixture in FIG. 1.
Figure 3:
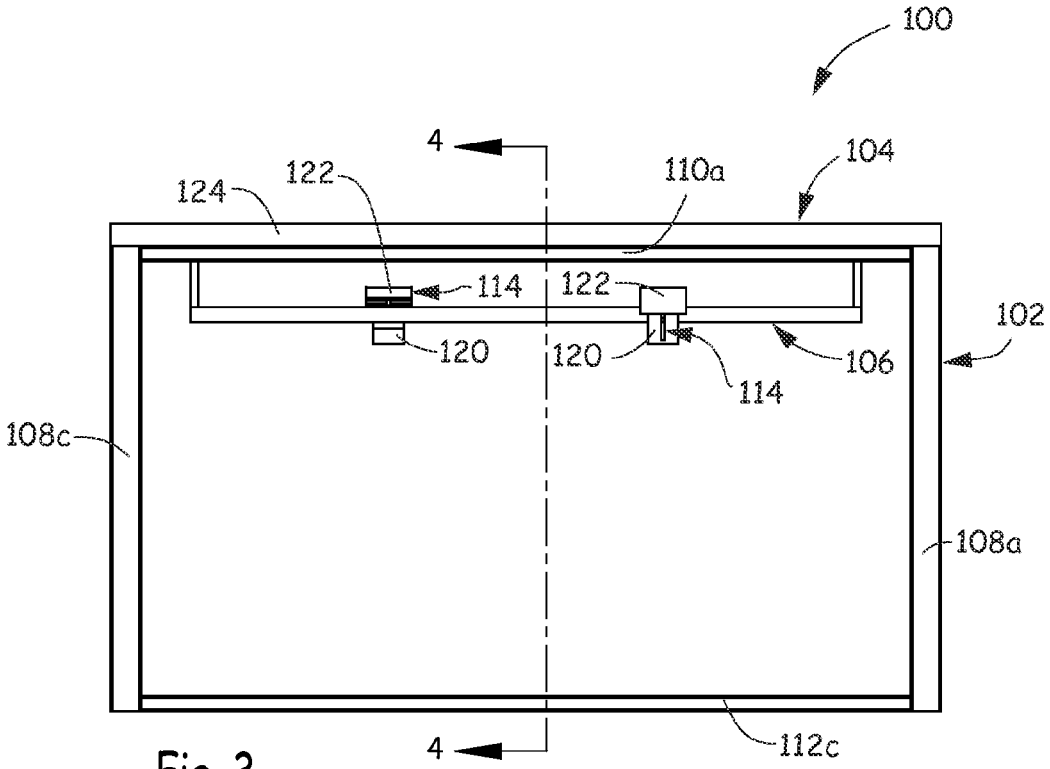
FIG. 3 is a front view of the display fixture in FIG. 1.
Figure 4:
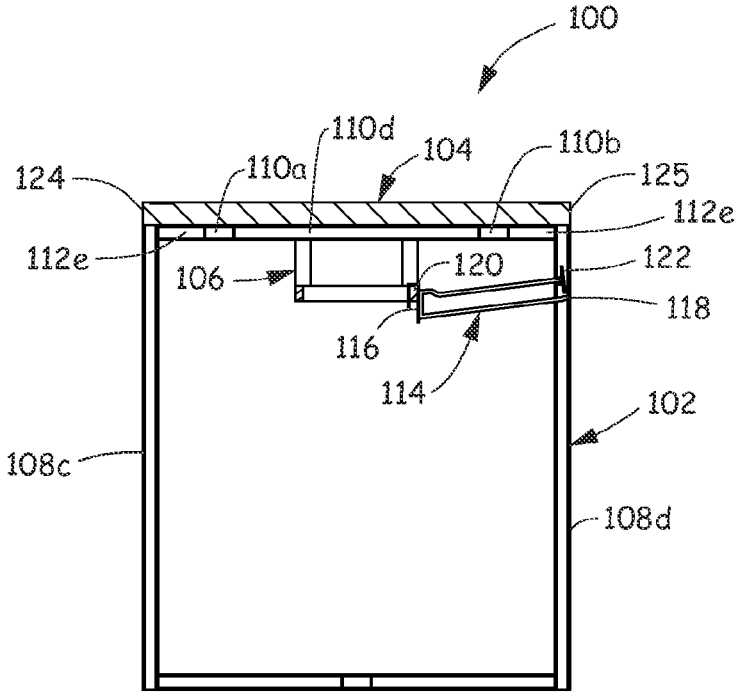
FIG. 4 is a section view of the display fixture in FIG. 1 and taken through the line indicated in FIG. 3.
Figure 5:
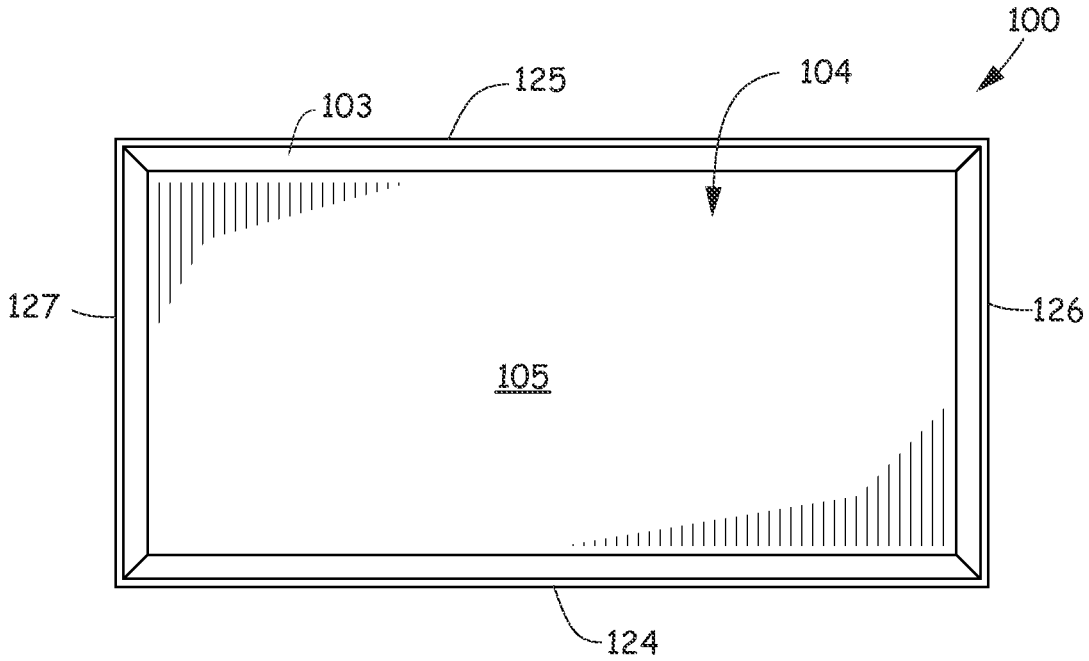
FIG. 5 is a top view of the display fixture in FIG. 1.
Figure 6:
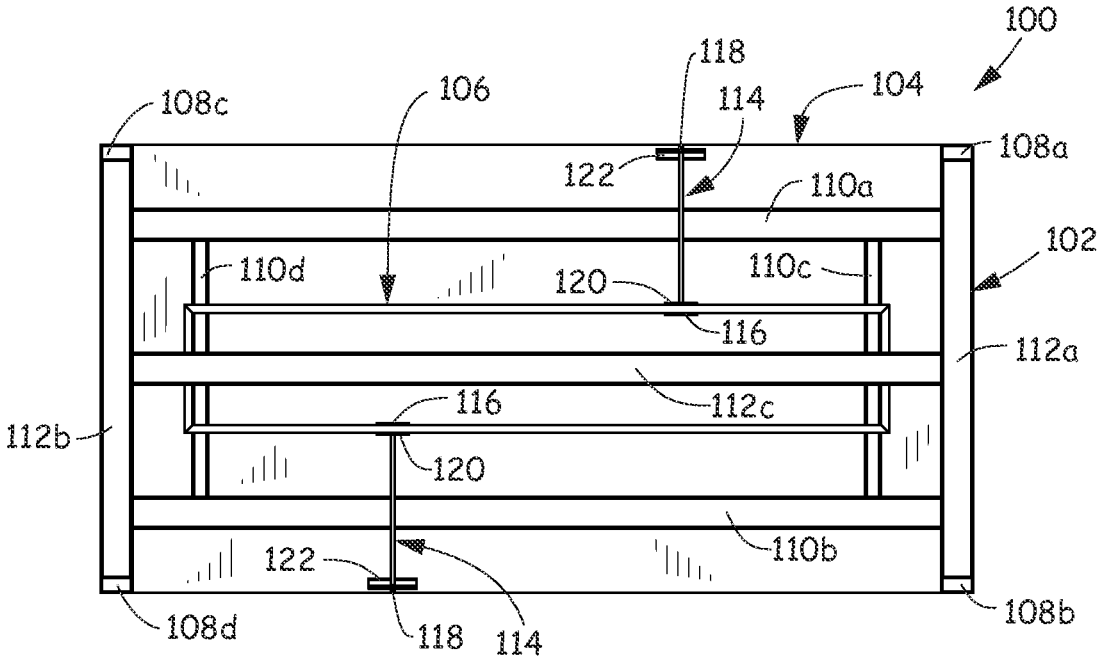
FIG. 6 is a bottom view of the display fixture in FIG. 1.

FIG. 1 is a perspective view of a display fixture 100 according to one embodiment and FIG. 2 is an exploded perspective view of display fixture 100. FIGS. 3, 5 and 6 are front, top and bottom views, respectively, of display fixture 100 and FIG. 4 is a section view of display fixture 100 taken through the line indicated in FIG. 3. Display fixture 100 includes a main support frame 102, a table top 104, an underframe or saddle frame 106 and at least one display hook 114. Main support frame 102 supports table top 104 as well as underframe 106 and underframe 106 supports each display hook 114.

Main support frame 102 includes a plurality of legs 108*a*, 108*b*, 108*c* and 108*d*, a plurality of table top support cross members 110*a*, 110*b*, 110*c* and 110*d* and a plurality of leg support cross members 112*a*, 112*b*, 112*c*, 112*d* and 112*e*. Legs 108*a*-108*d* are vertically oriented members that define a height 109, which is the distance between an upper surface 105 of table top 104 and the floor or how far above the floor upper surface 105 is located. All other members 110*a-d* and 112*a-e* are horizontally oriented members that connect legs 108*a-d* or provide cross support to legs 108*a-d* or to table top 104.

Legs 108*a* and 108*b* are coupled together by leg support cross member 112*a* at their bottoms and leg support cross member 112*d* at their tops. Legs 108*c* and 108*d* are coupled together by leg support cross member 112*b* at their bottoms and leg support cross member 112*e* at their tops. In addition, leg support cross member 112*c* couples leg support cross member 112*a* to leg support cross member 112*b* and therefore indirectly the bottoms of legs 108*a* and 108*b* to legs 108*c* and 108*d*. Table top support cross members 110*a* and 110*b* couple leg support cross member 112*d* to leg support cross member 112*e* and therefore indirectly the tops of legs 108*a* and 108*b* to legs 108*c* and 108*d*. Further, table top support cross members 110*a* and 110*b* provide horizontal support for table top 104. Table top support cross members 110*c* and 110*d* connect cross member 110*a* and 110*b* and provide anchoring pointed for underframe or saddle frame 106.

Figure 7:
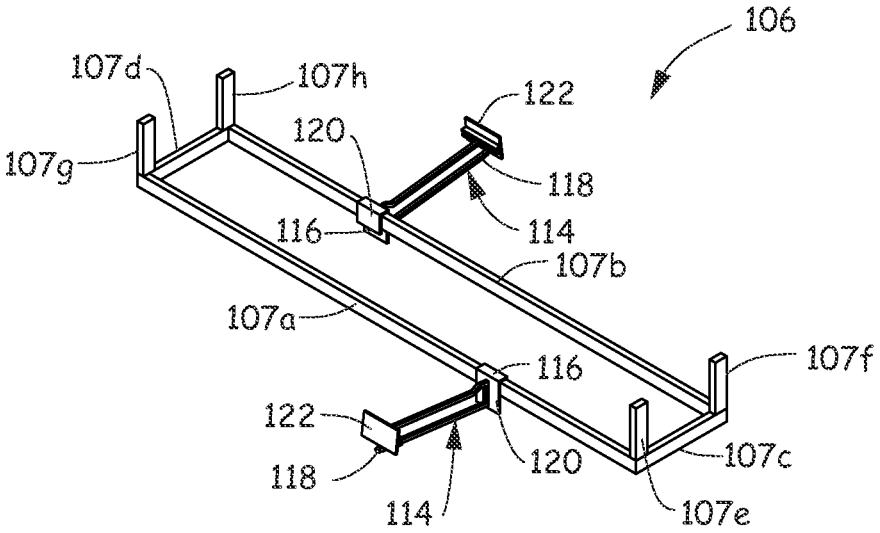
FIG. 7 is a perspective view of an underframe of the display fixture in FIG. 1.
Figure 8:
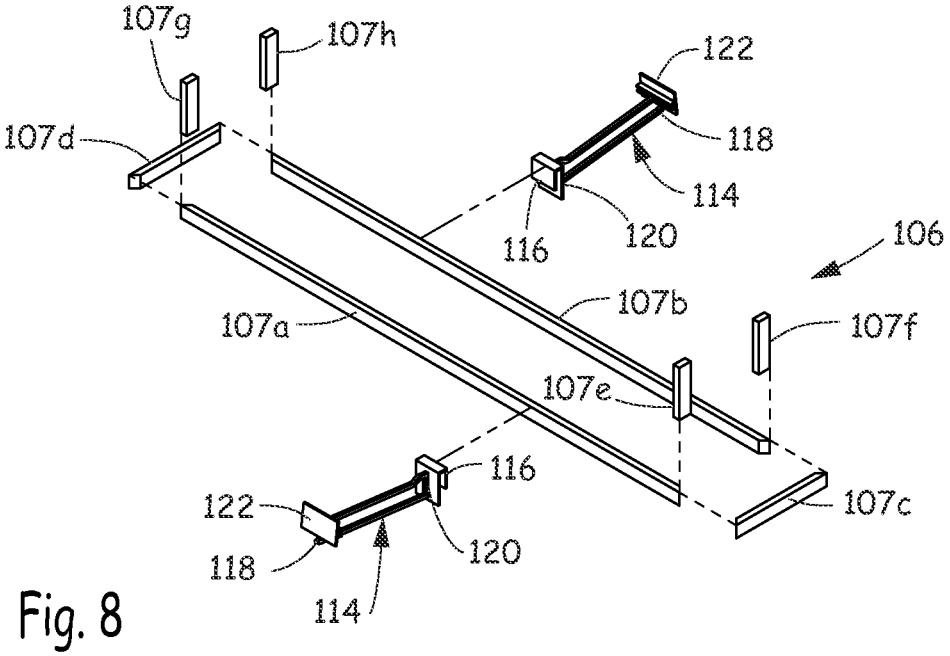
FIG. 8 is an exploded perspective view of the underframe in FIG. 7.

FIG. 7 is a perspective view of underframe or saddle frame 106 supporting display hooks 114 and FIG. 8 is an exploded perspective view of underframe or saddle frame 106. Underframe 106 includes a plurality of support members including at least one cross member or cross bar. In particular and in the embodiment illustrated in FIGS. 1-8, underframe 106 includes a plurality of support members 107*a-h*. As illustrated in FIGS. 7 and 8, support members are substantially parallel to each other and are connected to each other by support member 107*c* at one end and by support member 107*d* at the opposite end to form a rectangular shape. At each corner of the rectangle, support members 107*e*, 107*f*, 107*g* and 107*h* extend upwardly so as to be mounted to an underside of cross members of main support frame 102.

After underframe 106 is mounted to main support frame 102, support members 107*a* and 107*b* become cross members or cross bars that extend in a direction that is horizontally oriented and substantially parallel with table top cross members 110*a* and 110*b* of main support frame 102. However, supports members 107*a* and 107*b* are shorter than table top cross members 110*a* and 110*b* and are centered with respect to table top cross members 110*a* and 110*b*. Support members 107*c* and 107*d* of underframe 106 are also horizontally oriented and, as described above, couple the ends of cross member or cross bar 107*a* to the ends of cross member or cross bar 107*b*. Support members 107*e-h* of underframe 106 are vertically oriented and couple the ends of cross members or cross bars 107*a* and 107*b* and the ends of support member 107*c* and 107*d* to main support frame 102 so that underframe 106 is attached to bottoms of table top support members 110*c* and 110*d*. In this way, underframe 106 is located underneath table top 104, which sits on top of main support frame 102 or on top of cross members 110*a*, 110*b*, 110*c*, 110*d*, 112*d* and 112*e*, and extend downwardly from support member 110*c* and 110*d*.

Table top 104 includes upper surface 105, a front end 124, a back end 125 and a pair of opposing side ends 126 and 127. Table top 104 further includes a perimeter label holder 103. Label holder 103 receives labels that describe the product being displayed on upper surface 105 of table top 104 including at least a price. Perimeter label holder runs adjacent to all four ends of table top 104 including front end 124, back end 125, right side end 126 and left side end 127.

As illustrated in FIGS. 1-8, display fixture 100 further includes at least one display hook or display arm 114 that supports hanging products. Each display hook or display arm 114 is cantilevered from a support member of underframe 106 and includes a proximal end 116 and a distal end 118. Proximal end 116 of display hook 114 is removably coupled to and supported by underframe 106. More particularly, proximal end 116 of display hook 114 includes a bracket 120. Bracket 120 slides over cross member or cross bar 107*a* or 107*b* of underframe 106 and removably couples proximal end 116 of display hook 114 to underframe 106. As illustrated in FIGS. 2, 4, 6, 7 and 8, bracket 120 includes an open bottom, two opposing flanges and a top. The cross member or cross bar 107*a* or 107*b* is received by bracket 120 through the open bottom, the top of bracket 120 rests on the cross member or cross bar 107*a* and 107*b* and the flanges of bracket 120 straddle either side of the cross member or cross bar 107*a* and 107*b*. It should be realized, however, that each display hook 114 can be removably coupled or removably mounted to underframe 106 in other ways.

As illustrated in FIGS. 1-4 and 6-8, distal end 118 of display hook 114 includes a label holder 122. Label holder 122 holds a label that describes the products hanging on display hook 114 including a price and other relevant information. As shown, display hook 114 extends from proximal end 116, which is coupled to underframe 106 and terminates at distal end 118, which is directly below an end of table top 104 so that label holder 120 is viewable to a customer, but proximal end 116 is hidden from view. As illustrated in FIGS. 1 and 6, proximal end 118 of one display hook 114 is located directly below front end 124 of table top 104. As illustrated in FIGS. 4 and 6, proximal end 118 of one display hook 114 is located directly below back end 125 of table top 104.

Although display fixture 100 only shows two display hooks 114, it should be realized that more or fewer than the two display hooks can be used. Regardless of how many, each distal end 118 of each display hook 114 is located directly below front or back ends 124 and 125 of table top 104. In fact, as illustrated in the figures, at least one first display hook 114 extends from proximal end 116 that is removably coupled to first cross member or first cross bar 107*a* of underframe 106 and terminates at distal end 118 located under front end 124 of table top 104. At least one second display hook 114 extends from proximal end 116 that is removably coupled to second cross member or second cross bar 107*b* of underframe 106 and terminates at distal end 118 located under back end 125 of table top 104.

Still further, while FIGS. 1-8 illustrate a display hook 114 mounted to cross member 107*a* of underframe 106 and a display hook 114 mounted to cross member 107*b* of underframe 106, it is also possible for a display hook 114 to be mounted to support member 107*c* and for a display hook 114 to be mounted to support member 107*d*. In this way, a distal end 118 of a display hook 114 can be located directly below the opposing side ends 126 and 127 of table top 104. More specifically, at least one third display hook 114 can extend from a proximal end 116 that is removably coupled to support member 107*c* of underframe 106 and terminate at a distal end 118 located under side end 126 of table top 104 and at least one fourth display hook 114 can extend from a proximal end 116 that is removably coupled to support member 107*d* of underframe 106 and terminate at a distal end 118 located under side end 127 of table top 104.

Figure 9:
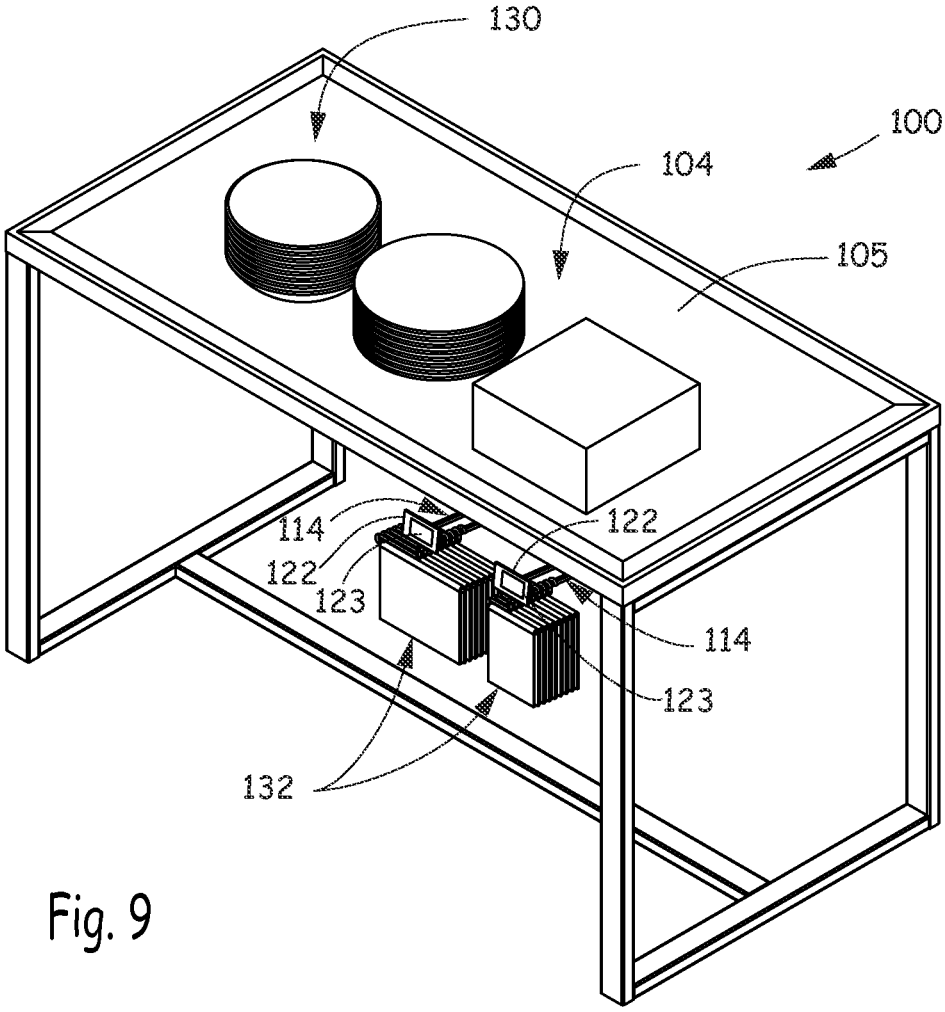
FIG. 9 is another perspective view of the display fixture in FIG. 1 with product sitting on the table top and hanging products loaded on the display hooks.

FIG. 9 is another perspective view of display fixture 100 with product or merchandise 130 sitting on table top 104 and hanging products 132 loaded on display hooks or arms 114. Display fixture 100 provides a method of displaying products. Products or merchandise 130 are set on an upper surface 105 of table top 104. Hanging products 132 are loaded onto display hooks or arm 114. Proximal ends 116 (shown in FIGS. 7 and 8) are removably coupled to underframe 106 located under table top 104. This allows display hooks 114 to be placed anywhere along cross members or cross bars 107*a* and 107*b* and be rearranged as needed. More specifically, each display hook 114 is attached to underframe 106 using bracket 120.

Distal ends 118 (shown in FIGS. 7 and 8) include label holders 122 and each label holder 122 is located directly below either a front or a back end of table top 104. As illustrated in FIG. 9, labels 123 are placed in label holders 122. Each label 123 describes the hanging products or merchandise being displayed by each display hook 114 and includes at least a price. When loading products or merchandise on display hooks 114, each display hook is loaded from proximal end 116 to distal end 118.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display fixture comprising:

a main support frame;

a table top supported by the main support frame;

an underframe attached to the main support frame and located underneath the table top wherein the underframe comprises a first cross bar and a second cross bar spaced apart from and substantially parallel to the first cross bar;

a first display hook that supports hanging products and extends from a proximal end that is removably coupled to the first cross bar and terminates at a distal end; and a second display hook that supports hanging products and extends from a proximal end that is removably coupled to the second cross bar and terminates at a distal end.

2. The display fixture of claim 1, wherein the underframe comprises a plurality of support members coupled together including the first and second cross bars.

3. The display fixture of claim 2, wherein the proximal ends of each display hook includes a bracket, wherein the bracket slides over one of the first cross bar and the second cross bar of the underframe to removably couple the proximal ends of the display hooks to the underframe.

4. The display fixture of claim 1, wherein the distal ends of each display hook comprises a label holder that holds a label describing the hanging products on each display hook.

5. The display fixture of claim 4, wherein each display hook extends from the proximal end coupled to the underframe and terminates at the distal end below an end of the table top so that the label holder is viewable to a customer and the proximal end is hidden from view from the customer.

6. The display fixture of claim 1, wherein the main support frame comprises a plurality of legs and at least one cross member, wherein the table top is located on top of the at least one cross member.

7. The display fixture of claim 6, wherein the underframe is coupled to a bottom of the at least one cross member.

8. The display fixture of claim 1, wherein the distal end of the first display hook is located under a first end of the table top and wherein the distal end of the second display hook is located under a second end of the table top that is opposite the first end of the table top.

9. A display fixture comprising:

a plurality of legs:

a plurality of cross members, wherein at least one of the plurality of cross members couple at least two of the plurality of legs together;

a table top located on top of the plurality of cross members, is supported by the plurality of cross members and the plurality of legs and is configured to support merchandise for display;

a saddle frame having a plurality of support members, is coupled to a bottom of at least one of the plurality of cross members and is located under the table top, wherein the plurality of support members comprise a first cross bar and a second cross bar spaced apart from and substantially parallel to the first cross bar; and a first display arm supporting merchandise for display, extending from a proximal end to a distal end and being cantilevered from the first cross bar of the saddle frame, the proximal end of the first display arm being removably coupled to the first cross bar and hidden from view by the tabletop and the distal end of the first display arm being in view;

a second display arm supporting merchandise for display, extending from a proximal end to a distal end and being cantilevered from the second cross bar of the saddle frame, the proximal end of the second display arm being removably coupled to the second cross bar and hidden from view by the tabletop and the distal end of the second display arm being in view.

10. The display fixture of claim 9, wherein the proximal end of each display arm includes a bracket, wherein each bracket slides over one of the first and second cross bars of the saddle frame to removably couple each of the proximal ends of each of the first and second display arms to the saddle frame.

11. The display fixture of claim 9, wherein the distal end of each of the first and second display arms terminate below an end of the table top.

12. The display fixture of claim 9, wherein the distal end of each of the first and second display arms comprises a label holder that holds a label describing the merchandise being displayed by the corresponding display arm.

13. The display fixture of claim 9, wherein the distal end of the first display arm is located under a first end of the table top and wherein the distal end of the second display arm is located under a second end of the table top that is opposite the first end of the table top.

14. A method of displaying products on a display fixture, the method comprising:

setting products on an upper surface of a table top of a display fixture; and loading hanging products on display hooks located under the table top of the display fixture, wherein a first display hook extends from a proximal end removably coupled to a first cross bar of an underframe located under the table top and terminates at a distal end located under a first end of the table top and wherein a second display hook extends from a proximal end removably coupled to a second cross bar that is spaced apart from and substantially parallel to the first cross bar and terminates at a distal end located under a second end of the table top that is opposite the first end of the table top wherein the distal end of each of the first and second display hooks includes a label holder and each label holder is located below an end of the table top.

15. The method of claim 14, further comprising placing a label in each label holder that describes the products hanging from the display hook to which the label holder is attached.

16. The method of claim 14, further comprising attaching the display hooks located under the table top of the display by sliding a bracket located on the proximal end of each display hook over a portion of the underframe to removably couple each proximal end of each display hook to the underframe.

* * * * *